United States Patent [19]

Leroux

[11] 3,963,134

[45] June 15, 1976

[54] MACHINE HAVING A DUAL FUNCTION JIB

[75] Inventor: Jean E. Leroux, Le Plessis-Belleville, France

[73] Assignee: Poclain, Le Plessis-Belleville, France

[22] Filed: Apr. 3, 1975

[21] Appl. No.: 564,655

[30] Foreign Application Priority Data

Apr. 22, 1974 France ..... 74.13944

[52] U.S. Cl. ..... 214/145 R; 37/117.5

[51] Int. Cl.[2] ..... E02F 3/81

[58] Field of Search ..... 214/145, 140, 765, 769, 214/777, 138 R, 131 R; 172/251, 254; 37/117.5

[56] References Cited

UNITED STATES PATENTS

| | | | |
|---|---|---|---|
| 3,126,110 | 3/1964 | Dinkloh | 214/131 R |
| 3,321,215 | 5/1967 | Kampert | 214/140 |
| 3,465,904 | 9/1969 | Pensa | 214/138 R |

FOREIGN PATENTS OR APPLICATIONS

| | | | |
|---|---|---|---|
| 2,063,511 | 6/1972 | Germany | 37/117.5 |
| 1,173,388 | 7/1964 | Germany | 214/131 |

*Primary Examiner*—Robert J. Spar
*Assistant Examiner*—Ross Weaver
*Attorney, Agent, or Firm*—Mason, Fenwick & Lawrence

[57] ABSTRACT

A dual function machine having a frame and a boom and means for adjusting the relative position of the frame and the boom, the frame having two mounting points each co-operable with a respective coupling on the boom to mount the boom on the frame in two different configurations. One of the configurations permits the machine to perform one function whilst the other configuration permits the machine to perform another function.

3 Claims, 4 Drawing Figures

MACHINE HAVING A DUAL FUNCTION JIB

This invention relates to civil engineering machines.

Machines are known which are furnished with an arm at the ends of which or at one of the ends of which are arranged permanently two implements.

The operating equipment of such machines is often complicated.

The invention means to alleviate this disadvantage by proposing a machine having a single boom having two coupling zones, by one of which it is connected to a support or frame or to another boom, and by the other at which is attached an implement or another boom, the arrangement being such that when the said boom is hinged by one of the zones to a frame it may be used to carry out a certain first operation whereas when it is hinged to the said frame by the other zone it may be used to carry out another operation distinct from the first.

Accordingly, the present invention provides a machine comprising a frame; a boom; two distinct hinge locations arranged on and fixed relative to the frame for coupling the boom to the frame; two couplings provided on the boom which correspond one with one of the hinge locations and the execution of one specific operation, and the other with the other hinge location and the execution of another specific operation; and means for adjustment of the relative position of this boom with respect to this frame.

Preferably, the couplings each define a hinge axis, the separation of the hinge axes being equal to the distance between the hinge location from the said other location.

It is in addition preferred that the boom is provided with a third coupling which in co-operation with one of said two couplings enables an auxiliary boom to be secured to said boom, and the assembly of these two booms to be mounted pivotally on the frame by means of the other of said two couplings.

Finally the means for adjustment may be coupled permanently between the boom and the frame.

The invention will be better understood from the following description of a preferred embodiment thereof, given by way of example only, reference being had to the attached drawings, in which.

Figure 2:
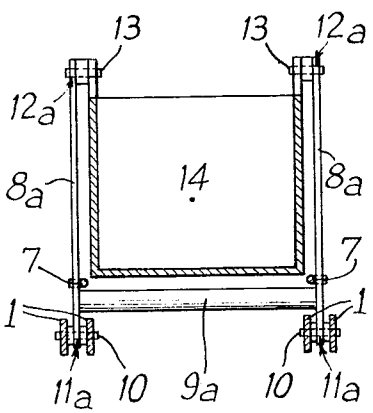
FIG. 2 is a section along II—II in FIG. 1.
Figure 1:
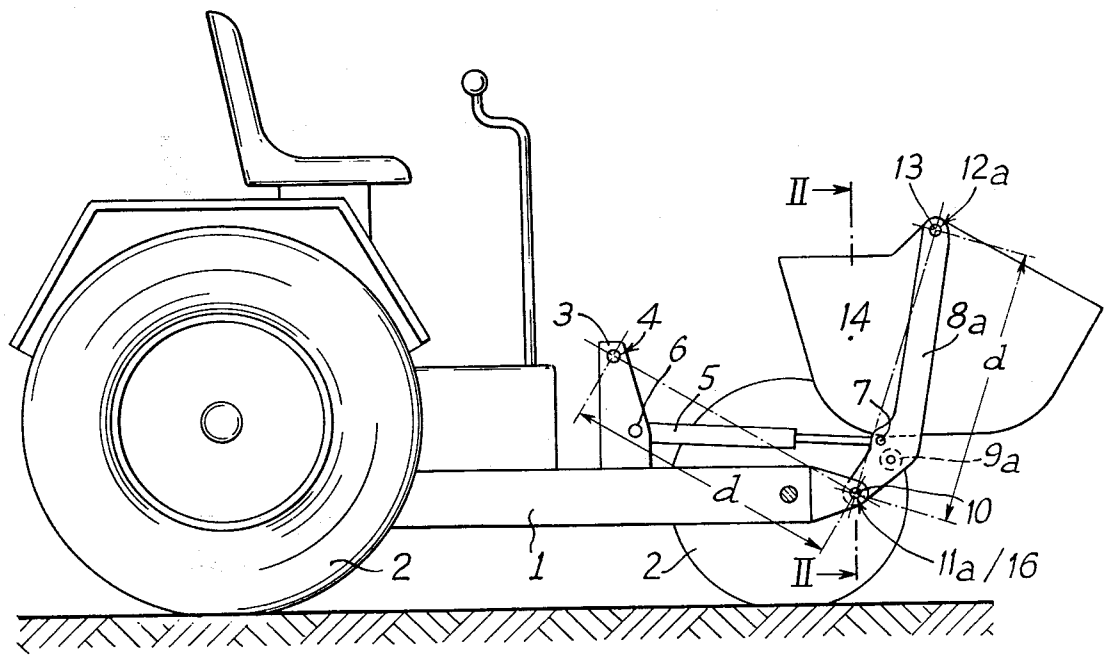
FIG. 1 is an elevation of an embodiment of a machine in accordance with the invention, in a configuration corresponding with a first use.
Figure 4:
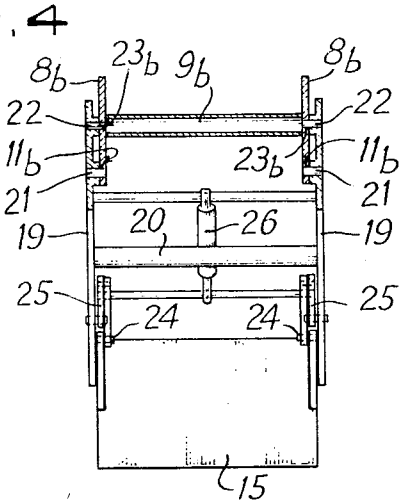
FIG. 4 is a section along IV—IV in FIG. 3.
Figure 3:
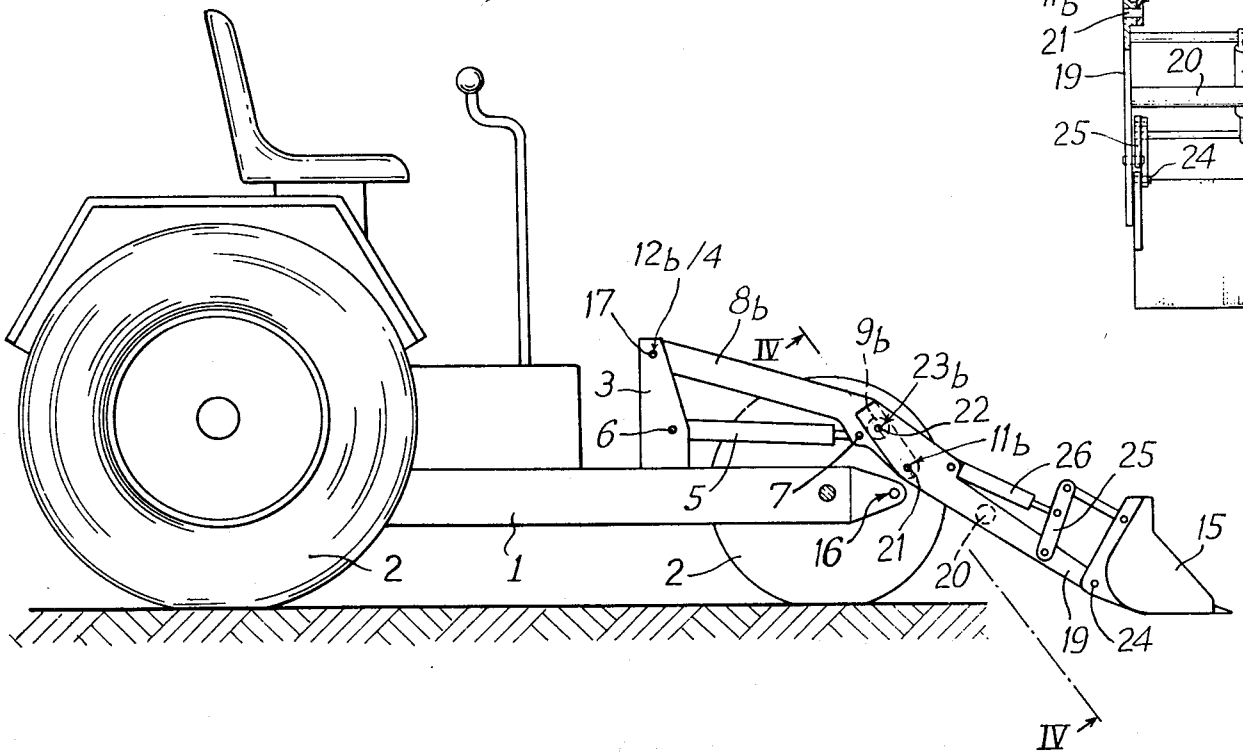
FIG. 3 is another elevation of the same machine but in another configuration corresponding with a second use.

The machine represented both in FIG. 1 and in FIG. 3 comprises a frame 1 provided with wheels 2. Uprights 3 secured to the frame 1 are provided with an aperture 4 enabling the introduction of a boom hingepin. A jack 5 is hinged permanently onto the uprights 3 about axes 6 and onto a boom about axes 7.

From FIG. 1 it will be observed that the boom is arranged at 8*a* and comprises two parallel arms connected by a lower crosspiece 9*a*. The arms are hinged onto the frame 1 about pins 10 which pass through apertures 11*a* with which one of the ends of each of the arms is provided, and apertures 16 in the frame 1. Apertures 12*a* are arranged in the other end of each arm and enable the introduction of pins 13 for the suspension of a material conveyor bucket 14.

Turning to FIG. 3, it will be observed that the boom is shown arranged at 8*b*, its crosspiece having come to

9*b* and the apertures in its ends being at 11*b* and 12*b*. The boom is no longer arranged for manipulating the conveyor bucket 14 but rather for supporting a loading scoop 15. The boom 8*b* is no longer hinged onto the frame 1 at the location of the apertures 16 but onto the uprights 3 by pins 17 which pass through the apertures 12*b* and the apertures 4.

Another boom 19 having two arms joined by a crosspiece 20 is secured to the boom 8*b* by pins 21 and 22 introduced respectively into the apertures 11*b* and 23*b* in the boom 8*b*. The scoop 15, hinged onto the boom 19 about pins 24, is furnished with a control compensator 25, and a jack 26 coupled between the boom 19 and the compensator 25.

It is to be observed that the distance *d* separating the apertures 4 in the uprights 3 and the apertures 16 in the frame 1 is equal to the distance separating the apertures 11*a* and 12*a* of the boom 8*a*.

The advantages of the arrangement described are considerable. Having provided two different hinge locations (the apertures 4 and 16) for the boom 8*a* (8*b*) with respect to the frame 1, one can carry out two entirely different types of operation such as the conveyance of material by the bucket 14 and excavation by the scoop 15, using a single boom.

When in addition the distance *d* separating the apertures 11*a* and 12*a* has been made, as in the example shown, equal to the distance separating the axes 4 and 16, changing of the axis of hinging of the boom 8*a* from the location of the apertures 16 to the location of the apertures 4, or vice versa, is very easy. It is sufficient by means of the jack 5 to bring into coincidence the apertures 11*a* and 16 and the apertures 12*a* and 4 and to introduce into or on the contrary to withdraw from these apertures the corresponding pins 10 and 17.

Finally, the fact of keeping the jack 5 permanently coupled to the uprights 3 by the pins 6 and to the boom by the pins 7 yet further facilitates the use of the machine.

One application of the invention lies in the achievement of a multi-purpose machine, immediate of adaptation to each of its uses.

The invention is not limited to the embodiment of it which has been given but on the contrary covers any variants upon it which might be applied to it without departing from its scope or its spirit.

What is claimed is:

1. A machine comprising: a frame; a boom; two distinct hinge locations arranged on and fixed relative to the frame for coupling the boom to the frame; two couplings provided on the boom which correspond one with one of the hinge locations and the execution of one specific operation, and the other with the other hinge location and the execution of another specific operation; said couplings each defining a hinge axis, the separation of the hinge axes being equal to the distance between the hinge locations; and means for adjustment of the relative position of this boom with respect to this frame.

2. A machine according to claim 1, wherein the boom is provided with a third coupling which in co-operation with one of said two couplings enables an auxiliary boom to be secured to said boom, and the assembly of these two booms to be mounted pivotally on the frame by means of the other of said two couplings.

3. A machine according to claim 1, wherein the means for adjustment is coupled permanently between the boom and the frame.

* * * * *